US005785803A

United States Patent [19]

Schiessl

[11] Patent Number: 5,785,803

[45] Date of Patent: Jul. 28, 1998

[54] APPARATUS FOR ATTACHING LITERATURE TO ARTICLES

[75] Inventor: Hans G. Schiessl, Dousman, Wis.

[73] Assignee: Krones, Inc., Franklin, Wis.

[21] Appl. No.: 735,447

[22] Filed: Oct. 15, 1996

[51] Int. Cl.[6] ..... B65C 9/00

[52] U.S. Cl. ..... 156/538; 156/456; 156/567; 156/571; 156/573

[58] Field of Search ..... 156/566, 567, 156/568, 570, 571, 578, 456, 542, 573, 538; 118/258

[56] References Cited

U.S. PATENT DOCUMENTS

| | | | |
|---|---|---|---|
| 3,288,108 | 11/1966 | Hilderbrandt | 118/258 |
| 4,143,754 | 3/1979 | Eldred | 156/567 X |
| 4,502,910 | 3/1985 | Voltmer et al. . | |
| 4,531,995 | 7/1985 | Gau | 156/567 X |
| 4,610,753 | 9/1986 | Voltmer et al. . | |
| 4,694,633 | 9/1987 | Fujio et al. | 156/86 X |
| 5,336,359 | 8/1994 | Pituch et al. . | |

OTHER PUBLICATIONS

Krones, Basics of Rotary Labeling (Sixth Edition), Jul. 1992.

*Primary Examiner*—James Engel

*Attorney, Agent, or Firm*—Ryan, Maki, Mann & Hohenfeldt

[57] ABSTRACT

A machine for applying outserts to articles such as bottles has a turntable driven about a vertical axis. A glue roller and an outsert dispenser are positioned in that order of turntable rotation adjacent the periphery of the turntable. A circular array of bottle support assemblies are mounted concentric to the turntable axis. A closed loop cam groove positioned below the turntable surrounds its rotational axis. Cam followers in the groove are connected to mechanisms that drive shafts on which the bottle support assemblies are mounted rotationally in response to turntable rotation. The support assemblies have a bottle holder plate on them in which plate there is a cavity for holding the bottle to which an outsert is to be adhered on a given outside wall area. The wall area is held at constant distance from the glue roller and the foremost outsert in the dispenser for all bottle sizes and shapes by having sets of holder plates in which the bottle cavity is off center by a sufficient amount for said wall area to be at the constant distance from the roller and dispenser.

8 Claims, 10 Drawing Sheets

FIG. 11
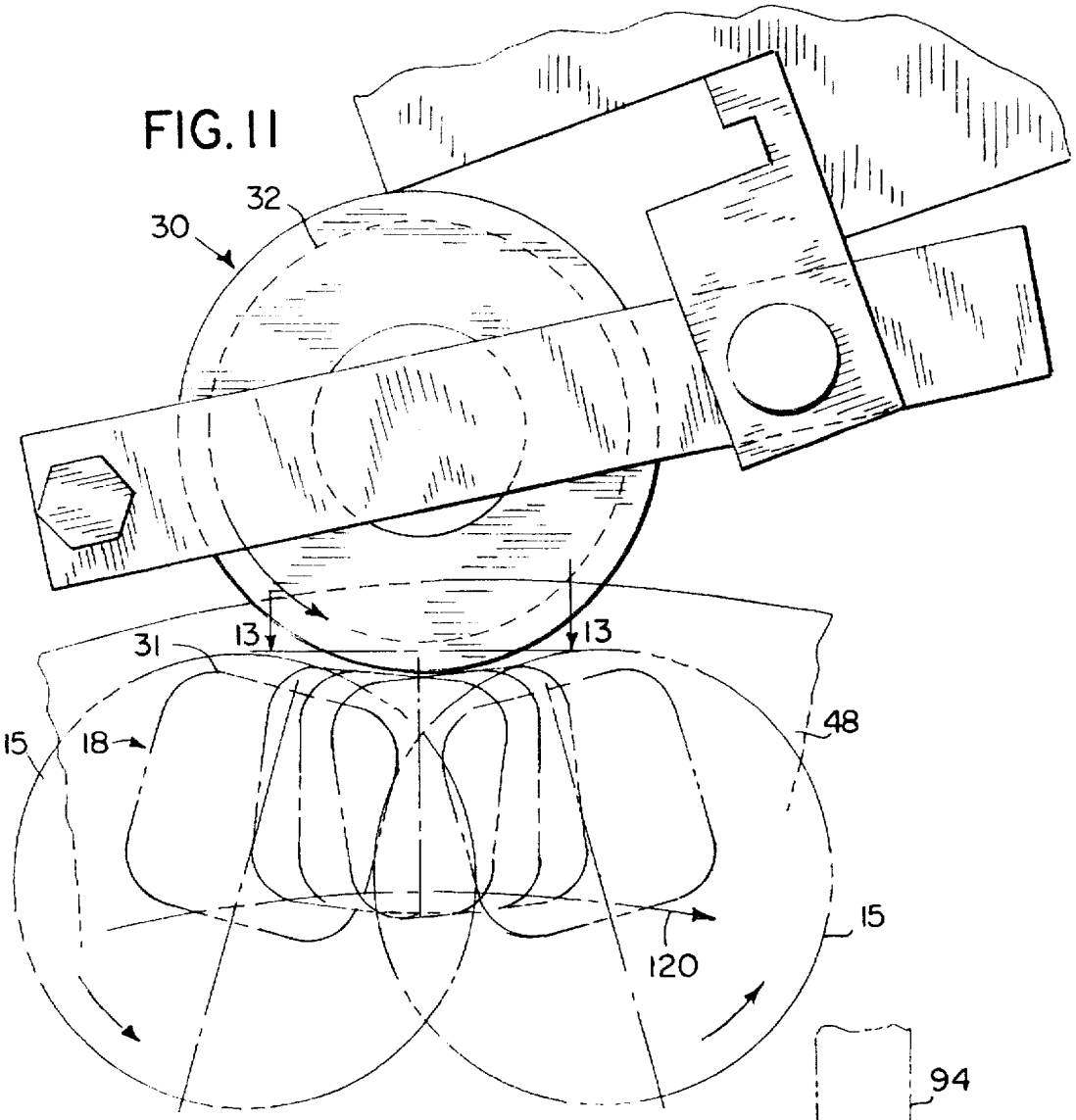
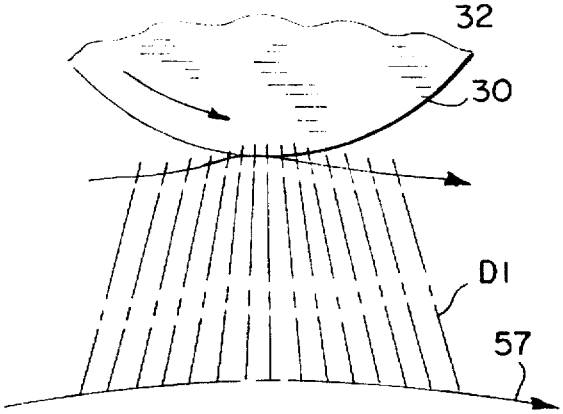
FIG. 12
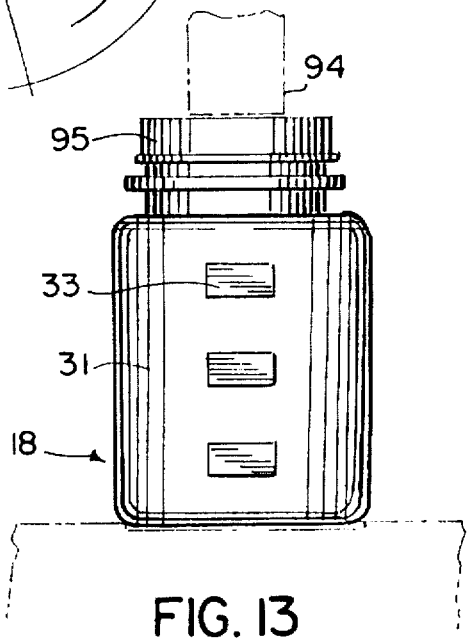
FIG. 13

APPARATUS FOR ATTACHING LITERATURE TO ARTICLES

BACKGROUND OF THE INVENTION

The invention disclosed herein pertains to attaching literature to articles including containers such as bottles of various sizes and shapes. The literature is called an "outsert" herein because it is customarily attached to an outside surface of an article. The common form of an outsert for a bottle comprises a long strip of paper containing printed matter. The paper is folded repeatedly to produce a compact multiple-page packet whose width is less than the width of the surface of the article to which the outsert is adhered. Although the new machine can adhere literature to a variety of articles, one important use of the invention will be described herein in connection with adhering outserts to bottles.

The pharmaceutical industry, for example, is a beneficiary of being able to attach outserts to bottles. It is, of course, common knowledge that conventional practice has been for bottles containing liquid and solid pharmaceuticals to be contained within a box or carton before being placed on sale in a drug store or other retail store. Thus, the information a purchaser of the pharmaceutical should know about, such as dosage, side effects, timing of the dosage, contraindications and others ought to be provided by way of a box, carton, by a printed insert or by means of an outsert without using a box or carton.

Some cartons are too small for application of outserts in which cases the containers must still be packaged in cartons or boxes along with the printed matter that explains to the purchaser how to properly use the contents of the container.

Vendors of bottles containing pharmaceuticals can provide much of the information a purchaser needs by way of an outsert that is attached to a bottle. One of the advantages of informing a purchaser by way of an outsert is that the traditional box or carton containing the bottle may be dispensed with since cartons or boxes have been used primarily as media to provide printed information to purchasers. Hence, the number of cartons that are destined to become unrecyclable trash can be reduced by using outserts.

Preexisting machines for attaching outserts to bottles have disadvantages. One disadvantage is that many of such machines conduct time-consuming operations such as transferring outserts from a vacuum transport drum to an adhesive-coated tape. These sequential operations take time and limit productivity of the machine. Moreover, releasable adherence of outserts to adhesive tape introduces a measure of instability and uncertainty in high speed handling and transporting of the outserts.

SUMMARY OF THE INVENTION

The new outsert attaching machine described herein avoids the disadvantages mentioned above and other disadvantages too. The new machine maintains a positive physical grip on the bottle or article before and after the outsert is attached and until the bottle is discharged from the machine. The machine is designed for being easily converted for processing bottles and other articles having widely different sizes and shapes.

The new machine uses some features which are conventional such as a circular turntable driven rotationally about a vertical axis. The top of the turntable has several equiangularly spaced apart rotationally oscillating bottle support plate assemblies arranged for moving in a circular orbital path under the influence of the rotating turntable. Although oscillating bottle plate support assemblies about a vertical axis is known, the oscillation protocol in the new machine differs from prior practice. A basically conventional bottle infeed starwheel places bottles on the support plate assemblies as they orbit on the turntable past the transfer station at the infeed starwheel.

In the new machine, according to the invention, oscillation of the support plates is carried out in a manner such that the orbiting bottles arrive consecutively at a station for applying glue to the bottle meeting the glue roller in perfect tangency and with rolling contact pressure while the bottle is rotating at a predetermined angular velocity due to the controlled oscillatory motion. Thus, the glue is applied in a roll-on motion rather than a wiping motion. After a column of glue spots are applied to a bottle, it is transported in orbit to an outsert dispenser from which an outsert is picked up by rolling the glue spots on the bottle onto the first outsert that is presented from the stack of outserts by the dispenser gate. At this time, according to the invention, the plate assembly oscillating mechanism maintains the peripheral velocity of the outsert application surface at the same velocity as the previously mentioned predetermined velocity which the bottle surface had when the glue spots were being applied so the machine functions in a stable, repeatable and predictable fashion.

The oscillating bottle holding and support plate assemblies actually comprise bottle support disks which have vertically downwardly extending shafts to provide for oscillating the disks and the uniquely configured bottle holding plates that are superimposed on and fixed to the respective disks. The new bottle holding plates are provided with a cavity in which the base of the bottle fits as it is pressed down by a bottle hold down device which is commonly called a centering bell. According to the invention, the cavity in the bottle holder plate in which the base of the bottle registers, is in a position on the holder plate such that the outside surface of the bottle wall on which the outsert is to be attached is always set at the same radial distance from the center of rotation of the bottle support disk shaft regardless of bottle width. This distance is calculated to assure that the outsert attachment surface of the bottle will develop the desired contact pressure with the glue roller and with the outsert as it is taken from the outsert dispenser. This radial distance is the same for bottles of all sizes and shapes within limits of the bottle sizes that the bottle holder plates can handle. If the user desires to make a run of bottles of a different size, it is necessary to exchange the bottle holding plates to plates that have cavities shaped complementary to the bottom of the bottle holding plates and to also exchange quick release subassemblies of the bottle centering bells, which are otherwise called the bottle hold-down devices herein as will be further explained later. For example, assuming a relatively small bottle that is square in cross-section is having outserts attached in a production run and it is desirable to convert the machine for applying outserts on a bottle that is more oblong or has a different diameter than the bottles currently being processed by the machine. In such case, the bottle holder plates for the previously processed smaller bottles are removed and plates having a cavity for accommodating the base of the larger oblong bottles are substituted. However, in accordance with the invention, the longer bottle cavity for the substitute oblong bottles is simply positioned on the holder plate with the bottle axis offset from the axis of bottle plate rotation such that the outsert application surface of the larger bottle will be at the same radial distance from the axis of the bottle support disks as was the case with the smaller bottles. It makes no difference as to what is the shape of a bottle as long as it has a surface or a wall which provides an area to which an outsert may be applied. Bottles may be elliptical or circular in cross-section, for example, but it is still possible to provide a holder plate with a cavity that positions the bottle with its outer application surface at the same radial distance from the bottle holder shaft axis for bottle sizes or widths that are smaller than the width or diameter of the bottle holder plates. The term "bottle" is used herein as a generic name for the article to which an outsert can be applied with the machine.

How the objectives and features of the new outsert attachment machine are implemented will be evident in the ensuing more detailed description of a preferred embodiment of the invention which will now be set forth in reference to the accompanying drawings.

DESCRIPTION OF THE DRAWINGS

FIG. 11 shows a glue roller and the manner in which a bottle in a cavity of a holder plate would approach and depart from the periphery of the glue roller;

FIG. 12 is a diagram for showing the path followed by the outsert application surface of an article such as a bottle as it orbited by the turntable depicted in FIG. 1;

FIG. 13 shows a bottle to which three glue spots have been applied by the glue roller depicted in FIG. 11;

DETAILED DESCRIPTION OF THE INVENTION

Figure 1:
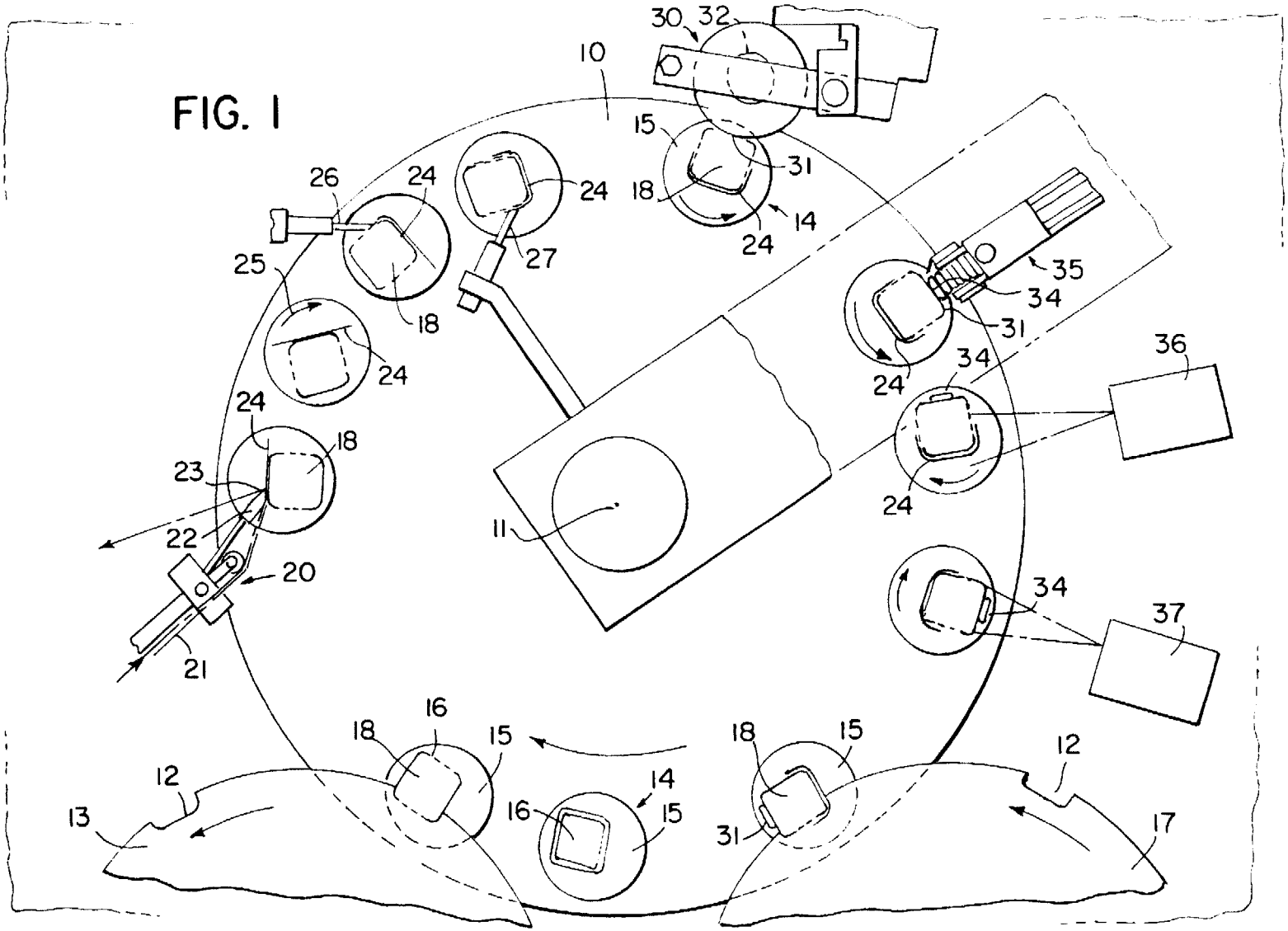
FIG. 1 is a diagrammatic top plan view of the new machine showing the large circular turntable on which there are a plurality of smaller circles representing article or bottle holder plates in various angular positions for the bottles supported thereon to undergo certain processing steps, although it should be understood that in the actual machine the bottle support plates and holders are equiangularly spaced apart and lie on a common circle at a predetermined radial distance from the rotational axis of the turntable.

FIG. 1 is a diagrammatic plan view of the machine for attaching labels and outserts to bottles. The machine comprises a turntable 10 which is driven rotationally about a vertical axis coincident with the point marked 11. The means for driving the turntable rotationally about a vertical axis are not shown in FIG. 1 since they are conventional. Bottles are provided to the machine by a conventional infeed screw, not shown. The bottles are transferred consecutively to pockets 12 of an infeed starwheel 13. The bottles are discharged from starwheel 13 to an oscillating bottle support disk and plate assembly. A typical assembly is indicated generally by the reference numeral 14. The assembly comprises an exchangeable bottle holder plate 15 in which there is a hole or cavity 16 that has a shape selected to complement the shape of the bottom or base of any bottle or article fed to the machine for the purpose of having an outsert attached. There is a support disk 55 beneath bottle holder plate 15 which is not visible in FIG. 1 but which will be shown and discussed in reference to other figures later. In FIG. 1, the bottle support plate assembly 14 which is in the lowermost position between infeed starwheel 13 and outfeed starwheel 17 does not have a bottle 18 inserted in its cavity 16 as yet. In other words, its bottle support assembly is presently unloaded and is conditioned for orbiting to its next angular position where it can accept a bottle 18 from infeed starwheel 13. It should be understood that in the actual machine, the bottle support assemblies 14 are equiangularly spaced apart around the machine axis 11. The bottle support assemblies 14 are shown in FIG. 1 spaced apart at unequal angular positions to facilitate describing various operations the bottles experience as they orbit with turntable 10 until they are finally removed from the machine by the outfeed starwheel 17.

In FIG. 1, an illustrative square bottle 18 has just been transferred from a pocket 12 of infeed starwheel 13 and the square base of the bottle is registered in the square cavity 16 of bottle holder plate 15. Observe that the center of the bottle holder cavity 16 is offset radially from the center or vertical axis of rotation of circular bottle holder plate 15. In this way, according to the invention, the periphery of a circular bottle or the wall of a square or oblong bottle or any bottle of another shape to which an outsert is to be attached is held at a constant distance from the central axis of the support plate for any size bottle. The bottle holder plates 15 are exchangeable for applying outserts to different bottle sizes and the exchanged plates will have a cavity 16 that is complementary to the size and shape of the base of the larger or smaller or otherwise-shaped bottles.

The machine is also provided optionally with well known means for applying pressure-sensitive adhesive labels to the bottle before the outsert is applied. A conventional label applicator device is used and is generally designated by the numeral 20. The label applicator is not part of the present invention. The pressure-sensitive adhesive labels are fed to the device on a web 21 which has a release material coating on it. The adhesive-coated side of the labels interfaces with the release material coating on the web. The web is drawn over a peeler 22 which has a beveled edge 23 about which the web is compelled to make a sharp turn which releases the label 24 and allows it to adhere to bottle 18. After leaving the pressure-sensitive adhesive label applicator device 20 with the label attached to the side opposite of the bottle to which the outsert will be attached, the holder plate rotates in the direction indicated by the arrow 25 and arrives at the next station or angular position where a brush 26 is positioned. Brush 26 wipes one end of the label 24 into adhesive contact with a side of the bottle 18. The bottle continues in its orbiting and rotational motion for arriving at the next station at which there is another brush 27 which wipes the other end of the self-adhering label onto the bottle.

After the self-adhering label 24 is attached to the bottle, turntable 10 carries the oscillating and orbiting bottle support 14 to proximity with a glue roller 30. The roller is comprised of resilient material which can yield radially by a small amount when the wall 31 of the bottle 18 is pressed against it so there is a positive application of glue to the bottle. It is the outer surface of wall 31 of the bottle onto which the outsert 34 will be adhesively attached. The glue applicator roller 30 has several annular axially-spaced apart grooves indicated by the dashed lines 32 so the full diameter periphery of the roller on axially opposite sides of the grooves deposit a plurality of axially separated glue spots on the bottle such as the three spots 33 shown in FIG. 13.

After application of the glue spots, the bottle in FIG. 1 orbits to the next station where the glued outside surface 31 of bottle 18 adheres to the foremost outsert 34 in an outsert dispenser 35, thereby attaching the outsert to the bottle. The bottle is then transported by turntable 10 past an optical bar code reader 36 which reads the bar code, not visible, on self-adhering label 24. Next the bar code on the outsert 34 is read by bar code reader 37. Finally, the bottle 18 arrives in alignment with a pocket 12 in output starwheel 17 which results in the bottle being removed from the turntable.

The consequence of the turntable 10 being driven rotationally about the vertical axis of rotation 11 as shown in FIG. 1 will now be discussed further in reference to FIG. 2. In this figure the machine bed is marked 40. Beneath bed 40 there is a conventional turntable drive system, not shown, comprised of a gear system, not shown, that drives a central machine shaft 41 about a vertical axis coincident with axis 11 in FIG. 1. Shaft 41 extends through a collar 42 which is fixedly mounted to machine bed 40. A plurality of equiangularly spaced apart radially extending arms 43 are clamped at 44 to collar 42. The radially outward end portions 45 of the arms are integral with member 46 having an annular channel or chamber 52 that is for containing the bottle support and holder plate driving mechanisms that will be described later. Because lubricating oil is sprayed on the mechanism in the non-rotating channel 46, a drain tube 47 is provided for recirculating oil that drips from the mechanism back to a sump, not shown, for a lubricant circulation pump which is also not shown.

Figure 2:
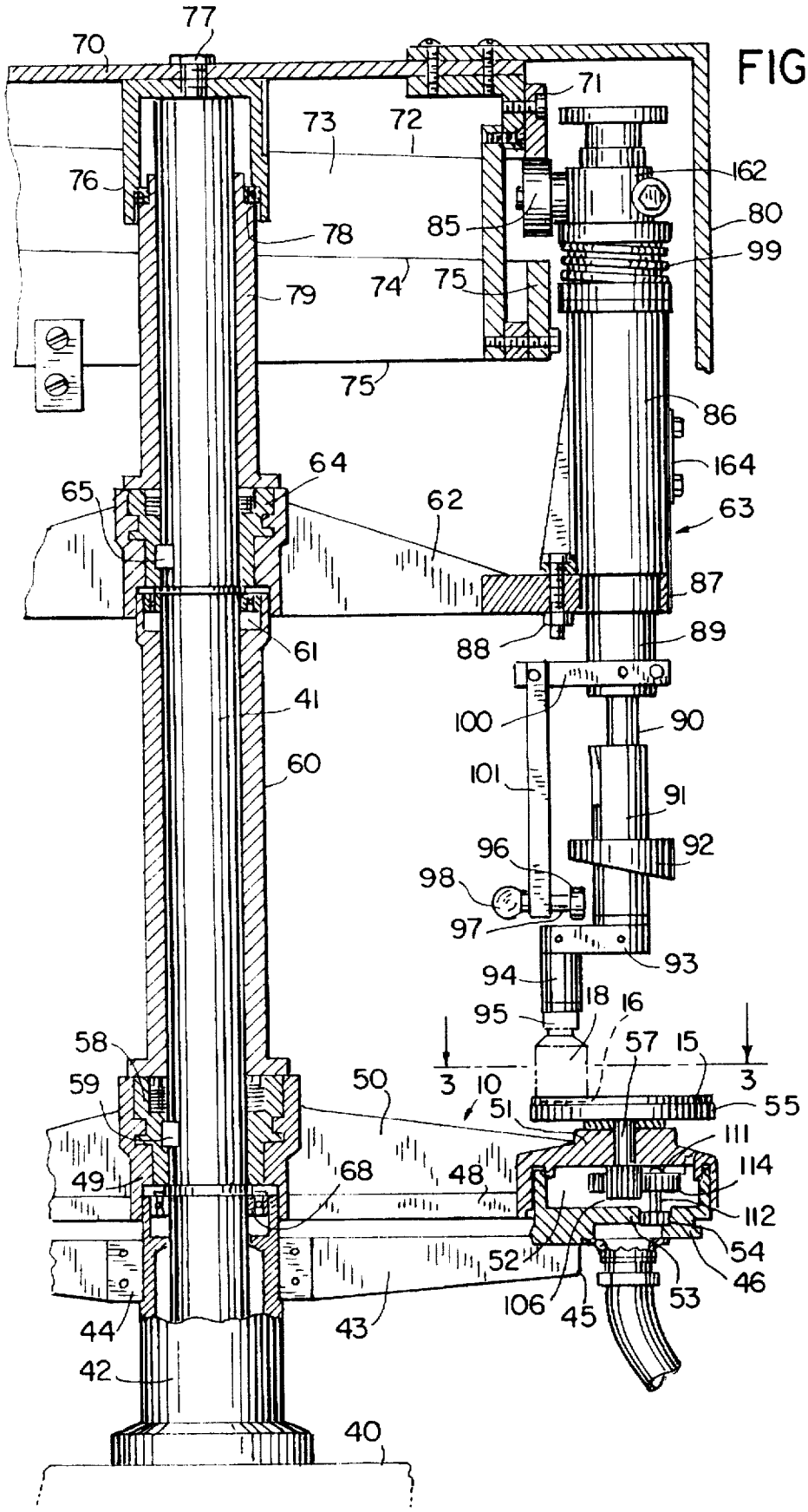
FIG. 2 is a vertical sectional view taken through the center of the turntable depicted in FIG. 1.

Turntable 10 in FIG. 2 comprises a large circular plate 48 which is a light weight cast aluminum part which extends radially from a hub 49. There are also a plurality of radially extending reinforcement ribs 50 cast on circular plate 48 which ribs also extend radially from hub 49. At their radial outward extremities, plates 48 and ribs 50 join integrally with and support an annular channel member 51 which is part of the turntable, and which, in conjunction with the lower stationary annular channel member 46 define a chamber 52 for containing mechanism that will be discussed later primarily in reference to FIGS. 5 and 6. FIG. 2 that lower stationary channel member 46 has a cam groove 53 which extends part way around the machine and is shown occupied by one of a plurality of cam follower rollers 54. The bottle support plate assembly is shown to comprise a substrate disk 55 on which bottle support plate 15 containing cavity 16 is mounted for holding a bottle 18. FIG. 2 shows that the cam follower roller 54 mounts to a gear segment 111 which will be discussed in more detail later in reference to FIGS. 5 and 6. FIG. 2 also shows one of the shafts 57 on which the bottle support plate assembly 14 is supported. Shafts 57 and, of course, the centers of substrate disks 55 and bottle holder plates 15 lie on a circle that is coincident with the machine circle. That is, shafts 57 are located at a constant distance from the center of rotation 11 of central shaft 41. FIG. 2 shows that the hub 49, which is aluminum in the actual machine, is cast on a collar 58 that is preferably made of steel. Collar 58 is keyed with keys 59 to power main turntable shaft 41 so that when shaft 41 turns, the turntable 10, comprised of plate 48 and ribs 50 along with upper annular channel member 51, turn together as a unitary turntable. A sleeve 60 is positioned concentrically to driven turntable shaft 41. Sleeve 60 does not rotate. It has a bearing 61 in its upper end. This bearing along with bearing 68 near the lower end of the shaft, support the shaft for rotation. A plurality of radially extending arms 62 support at their outermost ends bottle centering and hold down assemblies such as the typical assembly which is identified generally by the reference 63. Arms 62 are preferably composed of aluminum cast on a steel collar 64. Keys 65 are provided for enabling the shaft 41 to drive the collar rotationally. At the top of the machine, there is a plate member 70. A shroud having downwardly depending sides 80 is support from plate member 70. Plate 70 supports upper and lower cam tracks 71 and 75 having edges 71 and 74 which are spaced apart to define a cam groove 73. Plate member 70 has an open-ended cylinder 76 mounted to it by means of a machine bolt 77. A ball bearing 78 is arranged in cylinder 76 and provides further support for shaft 41 by way of a sleeve 79. Each of the centering and bottle hold-down devices 63 have a cam follower roller 85 which cooperates with cam groove 73 to raise and lower bottle a bottle hold-down element 94 at required times as will be explained later.

A general identification of the parts of the typical bottle hold-down and centering device 63 will now be given in reference to FIG. 2 although more details of the device and its operation will be given later. There is one hold-down device 63 above each bottle support disk 55 having a bottle holder plate 15 thereon. For the time being it is sufficient to observe that the hold-down assembly 63 comprises a cylindrical body 86 that is supported from radially extending arm 62 by a clamp 87 which is secured to arm 62 by means of a bolt 88. The body 86 has a plunger sleeve 89 that is moved up and down by reason of the cam follower 85 following cam groove 73 as the devices 63 orbit with the turntable. A shaft 90 projects out of plunger sleeve 89 and a collar assembly 91 is freely rotatable on that shaft. The collar assembly has a cam 92 mounted to it. Sleeve 91 also has a crank arm 93 mounted to its lower end. Crank arms are used for different bottle sizes. The crank arm has a downwardly extending force transmitting rod element 94 which engages the cap 95 of a bottle for stabilizing the bottle on its holder plate 15. A cam follower roller 96 is mounted to the end of a shaft 97 which is laterally retractable by use of a knob 98 which is involved in exchanging the entire assembly comprised of cylindrical collar 91, cam 92, crank 93 and hold-down element 94. These parts are exchanged when a changeover to a different bottle size or shape is made. Plunger 89 transmits a force to the bottle cap 95 under the influence of a spring 99 so the force applied to a cap 95 on a bottle 18 is not so great as to crush the cap or bottle. The vertical rotational axis of crank arm 93 aligns with the vertical axis of support disk 55 and its shaft 57 but the axis of hold-down element 94 is offset from the axis of the crank arm, as alluded to earlier, to have the surface of any size bottle to which an outsert is applied always at the same from the vertical axis of shaft 57.

The mechanism for oscillating the bottle support plate assemblies 14 will now be discussed in reference to FIGS. 5 and 6, primarily. First of all, consider the actuators 105 which are involved in oscillating the bottle support assemblies 14 about the axes of bottle disk 55 shafts 57. Shafts 57 have pinions 106 fixed to them by way of a key 107 and retainer plate 108. The shafts 57 are journaled in ball bearings 109 that are overlaid by a flexible seal 110. The actuators include a gear segment 111 which was previously mentioned while describing the turntable in reference to FIG. 2. The angular position of the gear segment is governed by the follower rollers 54 cooperating with the cam groove 53. Follower rollers 54 run on bushings 112. The gear segment is mounted to an arm 56 which also carries the follower roller 54. The arm swings on a shaft member 113 which is provided with a bushing 114. The shaft member 113 is secured to the turntable by means of screws 115. All of the shafts 113 are at an equal radial distance from the center of rotation or vertical axis of the turntable axis 41 and these shafts 113 do not move laterally of their respective axes. The shafts 57 on which the bottle support plate assemblies 14 are mounted have pinions 106 mounted to them. The teeth on the gear segments 111 mesh with these pinions. As the turntable rotates about its vertical axis, the follower rollers 54 follow the cam track groove 53 which results in the gear segments swinging in various directions, indicated by arrows next to them. The direction in which the gear segments 111 swing depends upon the distance of the cam groove 53 from the center of rotation 11 of the machine in which the follower is positioned at the moment.

Figure 6:
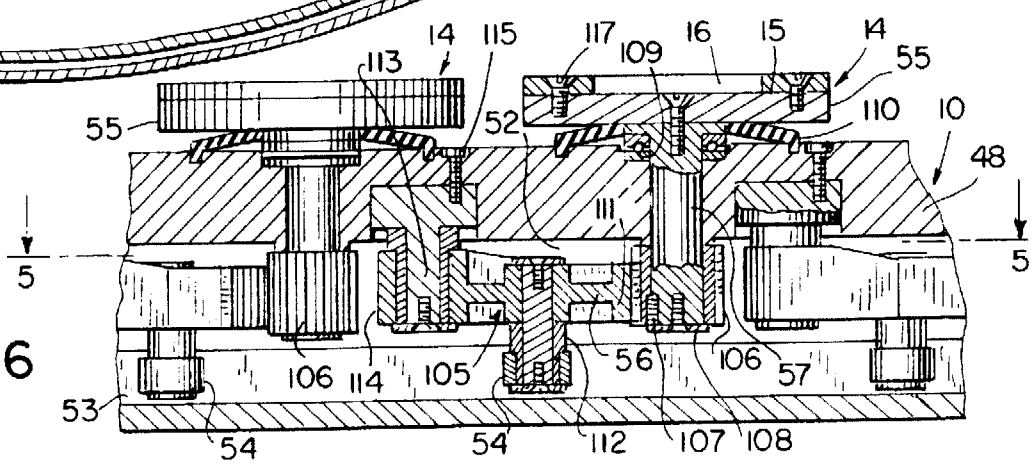
FIG. 6 is a partial vertical sectional view of two of the bottle support disks having bottle holder plates mounted thereon and the mechanism for oscillating them.

Observe in FIG. 6 that the bottle holder plates 15 are secured on the underlying disks 116 with screws 117. To switch the machine for handling different bottle sizes, the bottle holder plates 15 are removed by removal of screws 117 and different holder plates are installed which have a cavity 16 that has the configuration of the base of the bottles that are to be processed next.

Figure 3:
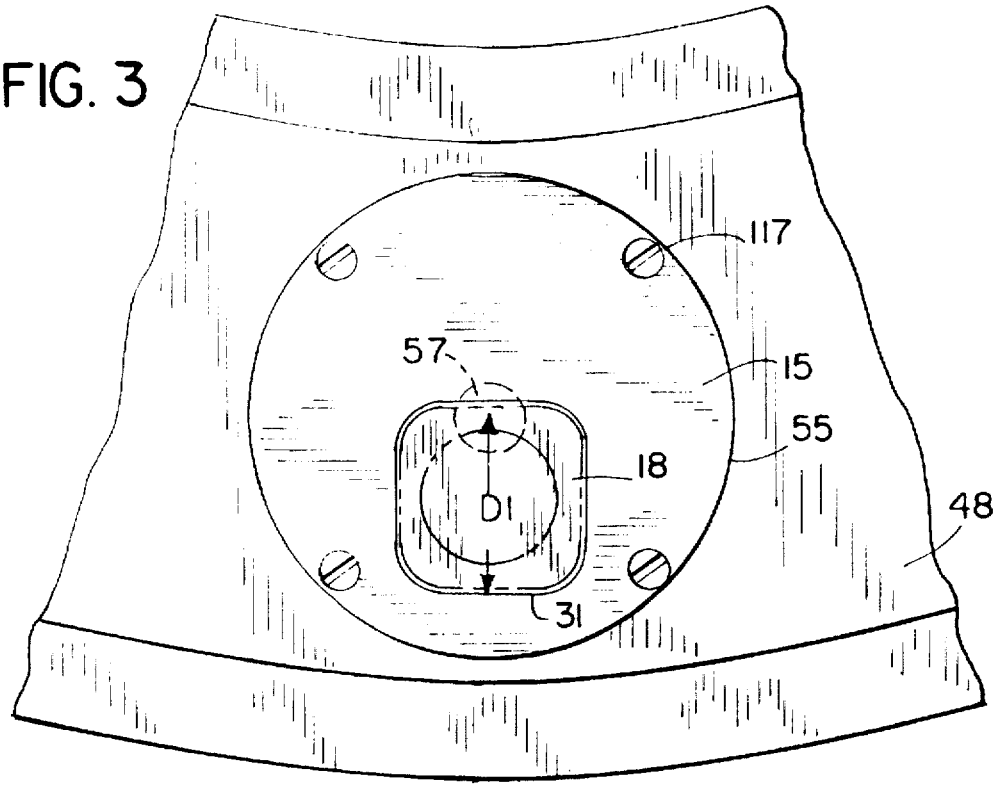
FIG. 3 is a plan view of an illustrative circular bottle holder plate which is adapted for retaining a bottle having a square base with the radially outermost surface of the bottle to which the outsert is to be attached maintained at a predetermined distance(D) from the center of rotation of the bottle support disk and the holder plate thereon.
Figure 4:
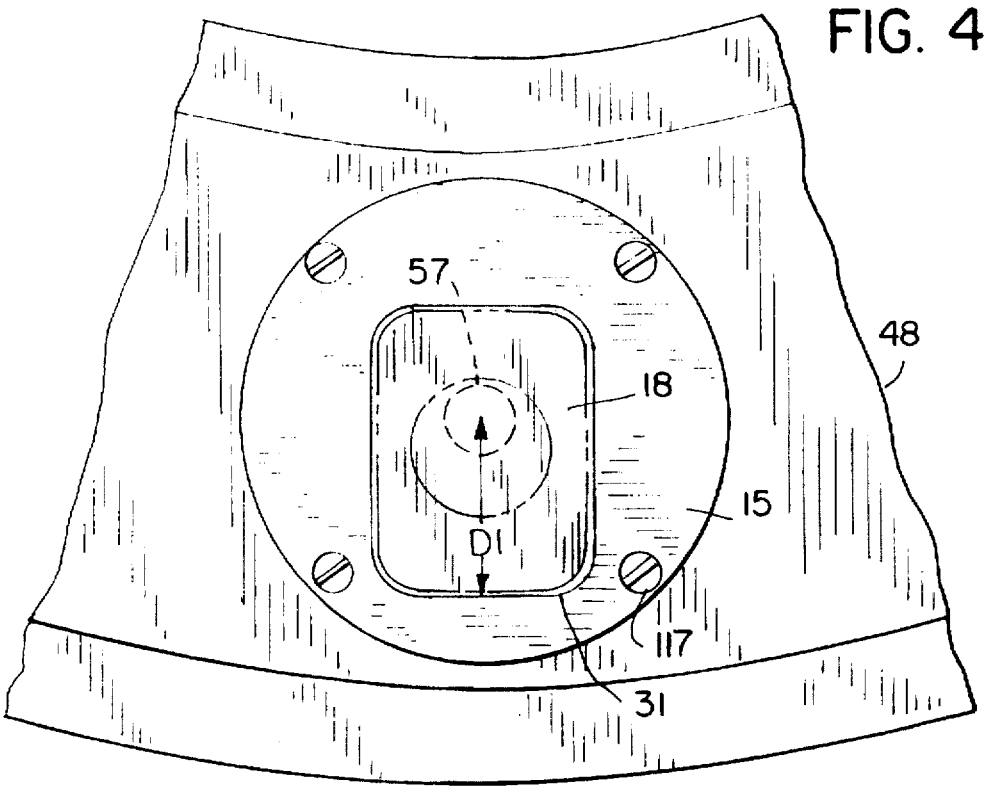
FIG. 4 shows a substitute bottle holder plate having a rectangular recess for retaining the base of an oblong or rectangular bottle whose radially outermost surface to which the outsert is attached is also at the same radial distance(D) from the rotational axis of the bottle support disk and the holder plate thereon as in the preceding FIG. 3.
Figure 5:
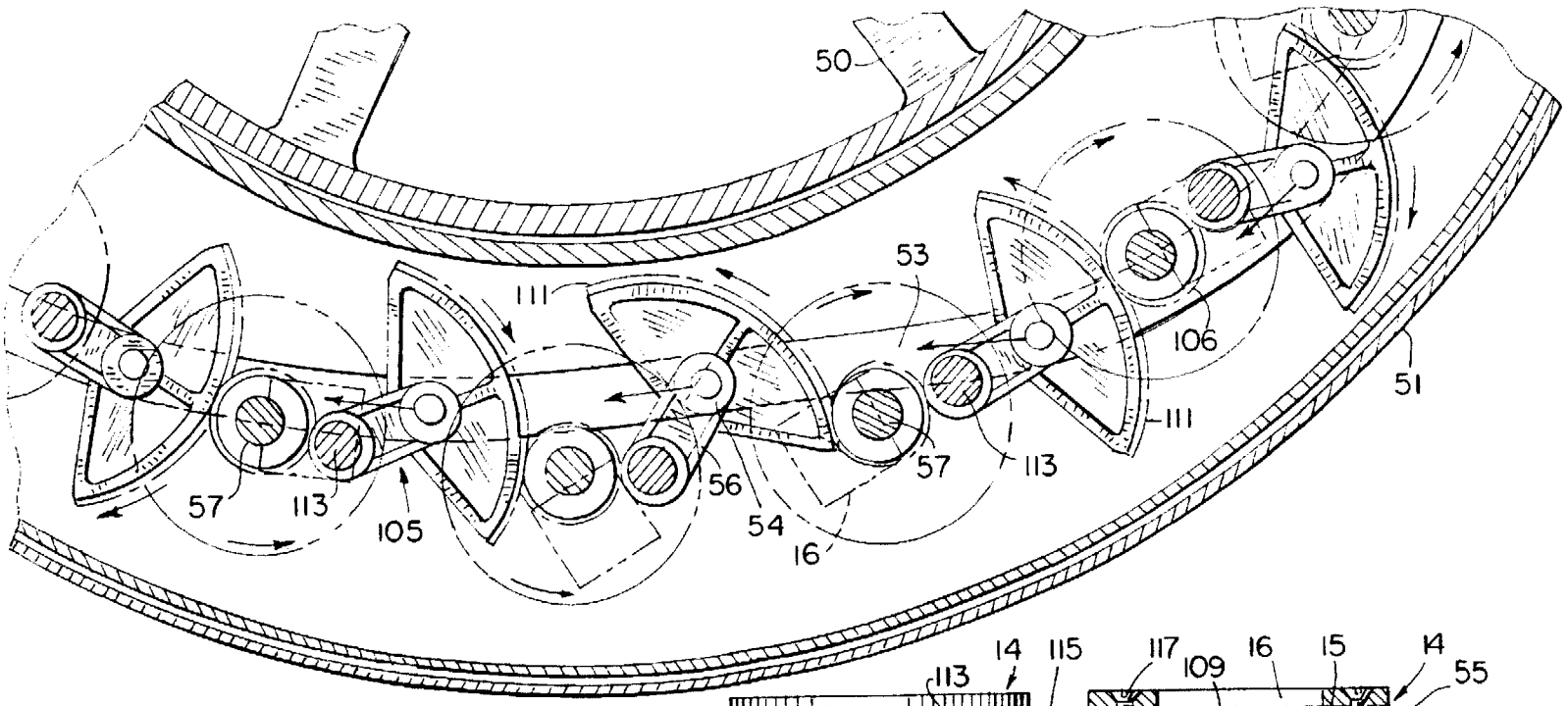
FIG. 5 is a sectional plan view of the space underneath the top plate of the turntable, taken on a line corresponding to 5—5 in FIG. 6, but with the top plate of the turntable removed to reveal the mechanisms which are involved in oscillating the support disks on which the bottle holder plates are mounted.

The benefit of using the bottle support plate actuating mechanism described in reference to FIGS. 5 and 6 can be appreciated by viewing FIGS. 3 and 4. In FIG. 3, the bottle holder plate 15 has a cavity 16 occupied by a square bottle 18. The distance from the center of rotation of the plate to the wall 31 of the bottle at which the outsert is to be applied is indicated by the distance D1. In FIG. 4, the plates 15 for the square bottles in FIG. 3 have been replaced by plates 15 for a typical oblong bottle 18. Because the cavity for the bottle base is simply shifted relative to the axis of rotation, one may see in FIG. 4 that the distance from the center of shaft 57 to the outside wall 31 of the bottle where the outsert is to be attached remains the same for all bottle sizes that fit within the circumference of the holder plate 15.

FIG. 11 shows how the bottle 18 on holder plate 15 approaches and departs from the glue roller as the bottle is transported or orbited by the turntable 48 in the direction of the arrow 120. Note, how the surface 31 of the bottle to which the glue is applied for holding the outsert translates and rotates as it goes in and out relative to the periphery of glue roller 30 and then proceeds with the plate 15 turning in the same direction as the bottle draws away from the periphery of the glue roller. The positions of the center line or line of symmetry D1 are exhibited in FIG. 12. In FIG. 12, the line which is followed by the center axis of the bottle support plate shaft axis 57 is given the same number 57 to indicate how the surface to which the outsert is applied is always at an equal distance from the center of rotation of the bottle support for any bottle size.

Figure 17:
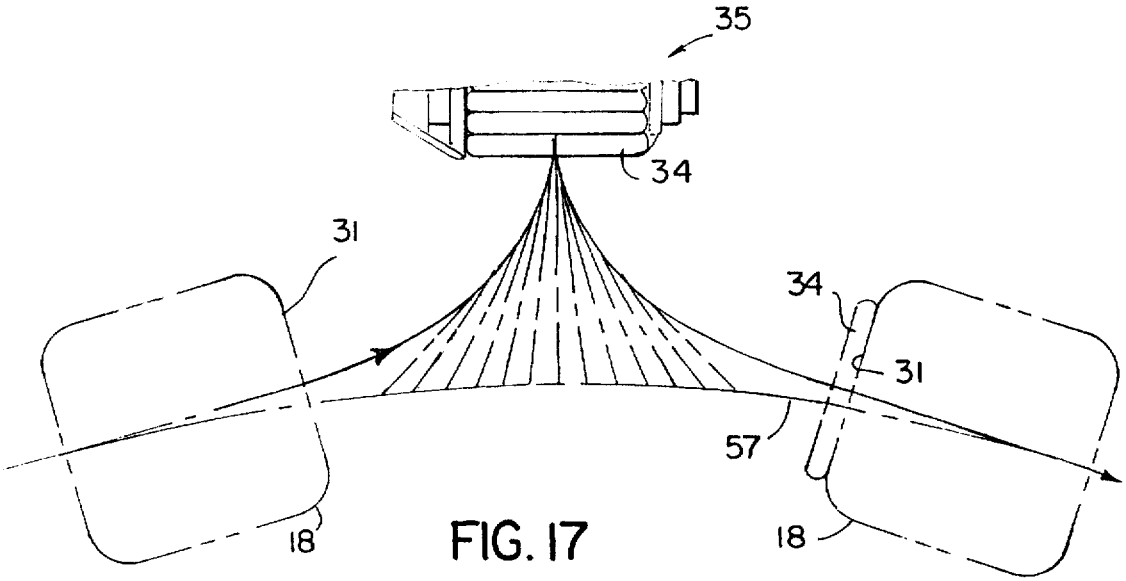
FIG. 17 is a diagram that is useful for showing the motion which the bottle executes as it approaches and departs from an outsert that is withdrawn from the outsert dispenser.

FIG. 17 is for illustrating that the bottle 18 executes the same motions as it approaches and departs from an outsert 31 as it executed when approaching and departing from the glue roller.

Figure 14:
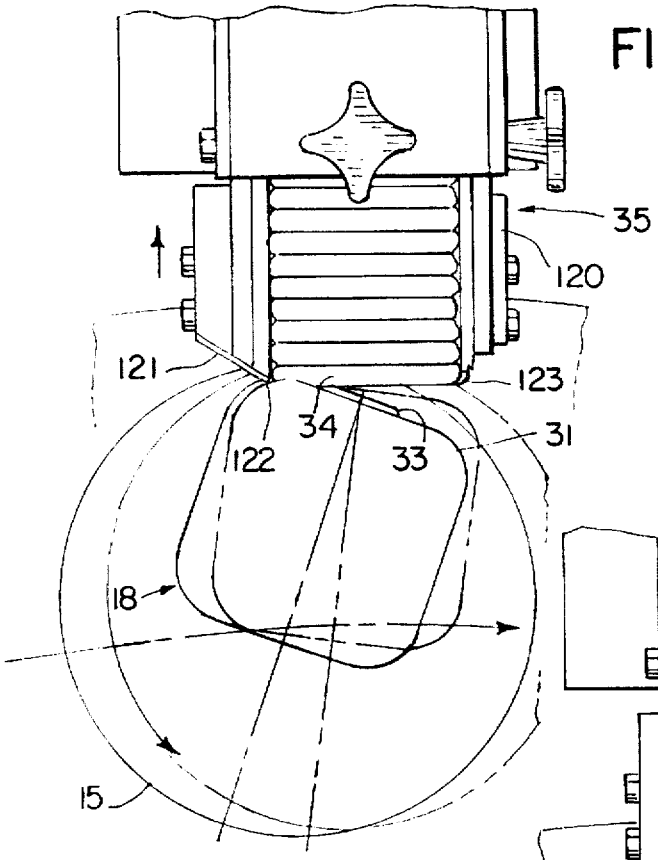
FIG. 14 is a diagram showing how the application surface of a square bottle approaches the foremost outsert in the row of outserts dispensed from a magazine.
Figure 15:
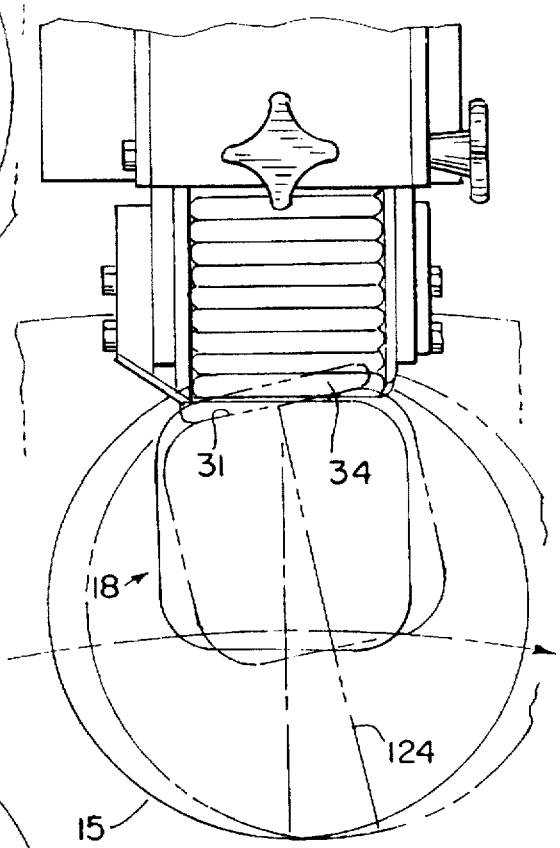
FIG. 15 is a diagram showing the position of a bottle immediately after it has picked up an outsert by adhesion.
Figure 16:
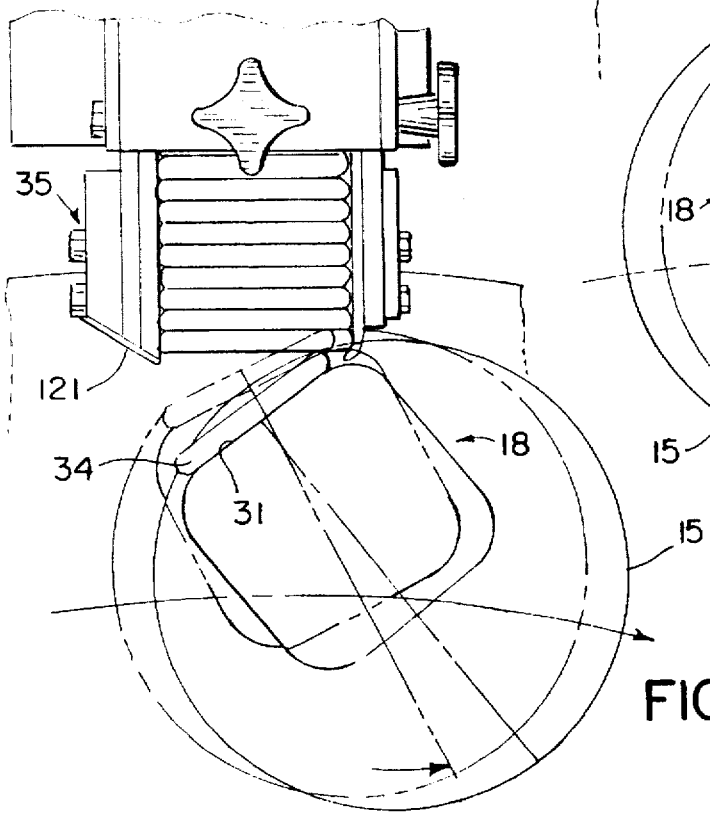
FIG. 16 shows the bottle in another stage of oscillation after it has picked up an outsert by adhesion.

FIGS. 14–16 show in more detail how the surface 31 to which the outsert 34 is attached cooperates with the outsert dispenser which is generally designated by the numeral 35. The outserts are stored in a channel-like dispenser tray 120 with a soft spring, not visible, and are biased toward the bottle so that the foremost outsert 34 will always be positioned in the tray as shown in FIG. 14. The dispenser tray 120 is slightly yieldable in opposition to a minor spring force. A tongue 121 extends from the tray and it terminates with a small interference to the outserts at the point marked 122. Another small interference is obtained with a small hook member 123. Thus, unless the outserts are pulled out of the dispenser tray, they will remain therein. FIG. 14 shows that the adhesive spots 33 on bottle wall 31 are beginning to roll onto a surface of the leading outsert 34. In FIG. 15, the bottle surface 31 is now adhered to an outsert 34 and the line of symmetry 124 is presently perpendicular to the outsert surface so that there is uniform contact by the surface of the outsert over the glue spots. Note also in FIG. 15 that, because the leading outsert 34 is backed up by other spring biased yieldable outserts, that the bottle can exert a slight compressive force on the leading outsert to assure that good adhesion of the outsert to the bottle is obtained before the bottle support plate 15 moves away. In FIG. 16 observe that the translating and oscillating bottle support plate 15 is rotating in a direction after an outsert is picked up by the bottle that assures the outsert will clear the next outsert in the dispenser 35 and will not be rubbed off the bottle as the bottle support translates.

The exchangeable bottle centering and hold-down device 63 was mentioned in connection with FIG. 2. A more detailed discussion of the structure and function of the exchangeable part of the device will now be set forth in reference to FIG. 8. The crank arm 63 at the lower end swings around the central axis of a stub shaft 130 to which the crank arm is fastened by a pin 131. Bottle hold-down element 94 extends vertically from crank arm 93 and has an elastic friction insert 132. Hold-down element 94 presses centrally of the cap 95 on the bottle. Thus, a crank arm 93 having a different radial length is required for each bottle of different size because the center of support shaft 57 for disk 55 will not ordinarily coincide with the center of the offset.

Figure 8:
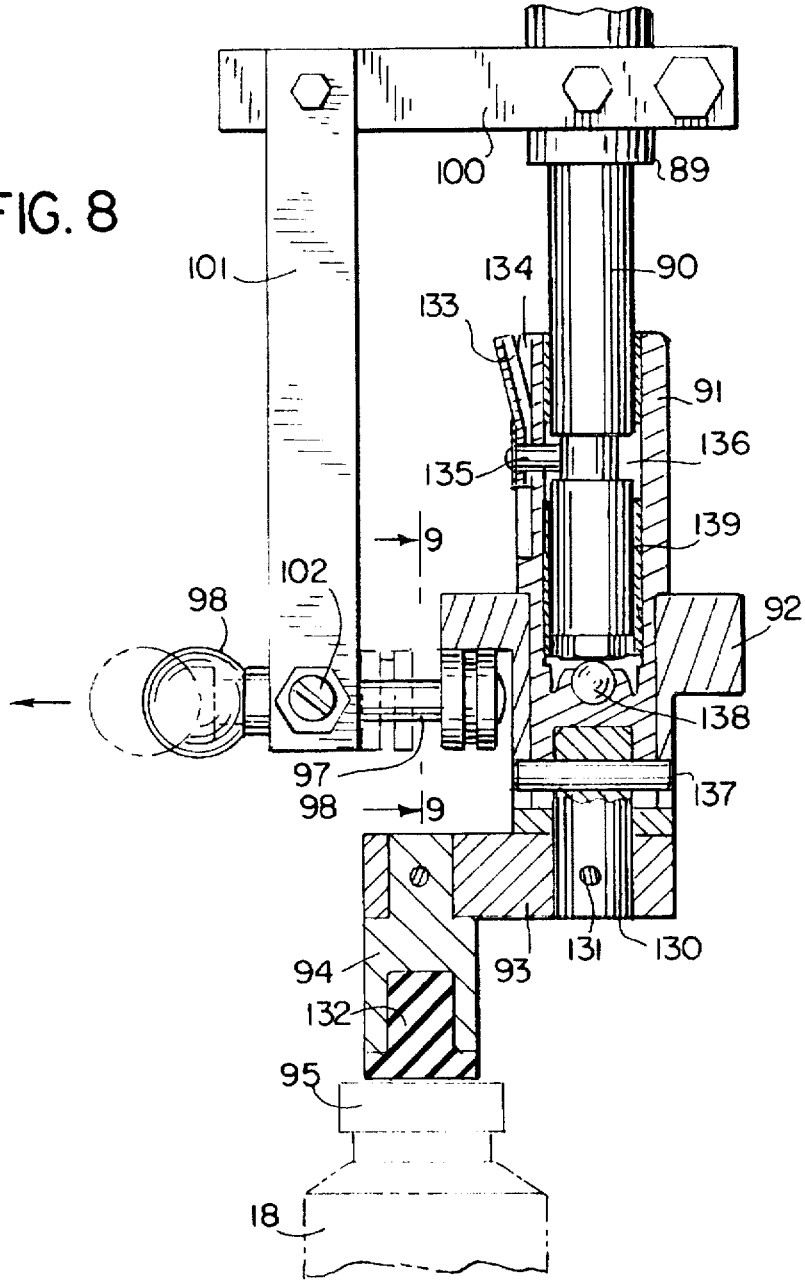
FIG. 8 is a vertical sectional view of one of the bottle hold-down devices and its associated mechanism for showing how the bottles are pressed down onto their holder plates while the bottles are being processed.

The crank arms are free wheeling about a vertical axis as they must be for the pressing elements 94 to stay centered on the caps 95 which are oscillating offset about the axes of the support plate assemblies 14. Changing crank arms 93 is accomplished by removing from shaft 90 everything mounted to it and replacing what is removed with a similar device having a different radial length crank arm 93. For releasing the device from shaft 90, a spring biased releasable latch lever 133 is provided. Pressing lever 133 into a groove 134 in cylinder body 91 of the device releases sleeve 91 for removal. A spring that biases the release lever 133 to its holding position as is presently the case in FIG. 8, is not shown. However, it will be observed that the release lever 133 controls a pin 135 that registers in an annular groove 136 in shaft 90. Thus, when the release lever 133 is pressed in FIG. 8, pin 135 is retracted from groove 136 and the whole body 86 is in readiness for being disconnected from shaft 90. A cam follower roller 96 cooperates with cam 92 as will be elaborated later. Follower roller 96 rotates on a stem 97 which is slidable in a hanger member 101. A clamping screw 102 holds stem 97 against unintended axial movement. Hanger member 101 is supported on arm 100 whose end is clamped to plunger sleeve 89. The entire device can be removed from shaft 90 by moving cam roller 96 out of interfering position relative to cam 92. This is done, after loosening set screw 102, by grasping knob 98 and pulling it to the left for the cam to clear the follower roller and then, while holding pin 135 in a retracted state, the device can be slid off shaft 90. Note that cam 92 is fastened to stub shaft 130 by means of a pin 137. When a vertical thrust force is applied by the hold-down device through shaft 90, the force is transmitted to a ball 138 which constitutes a thrust bearing.

Figure 7:
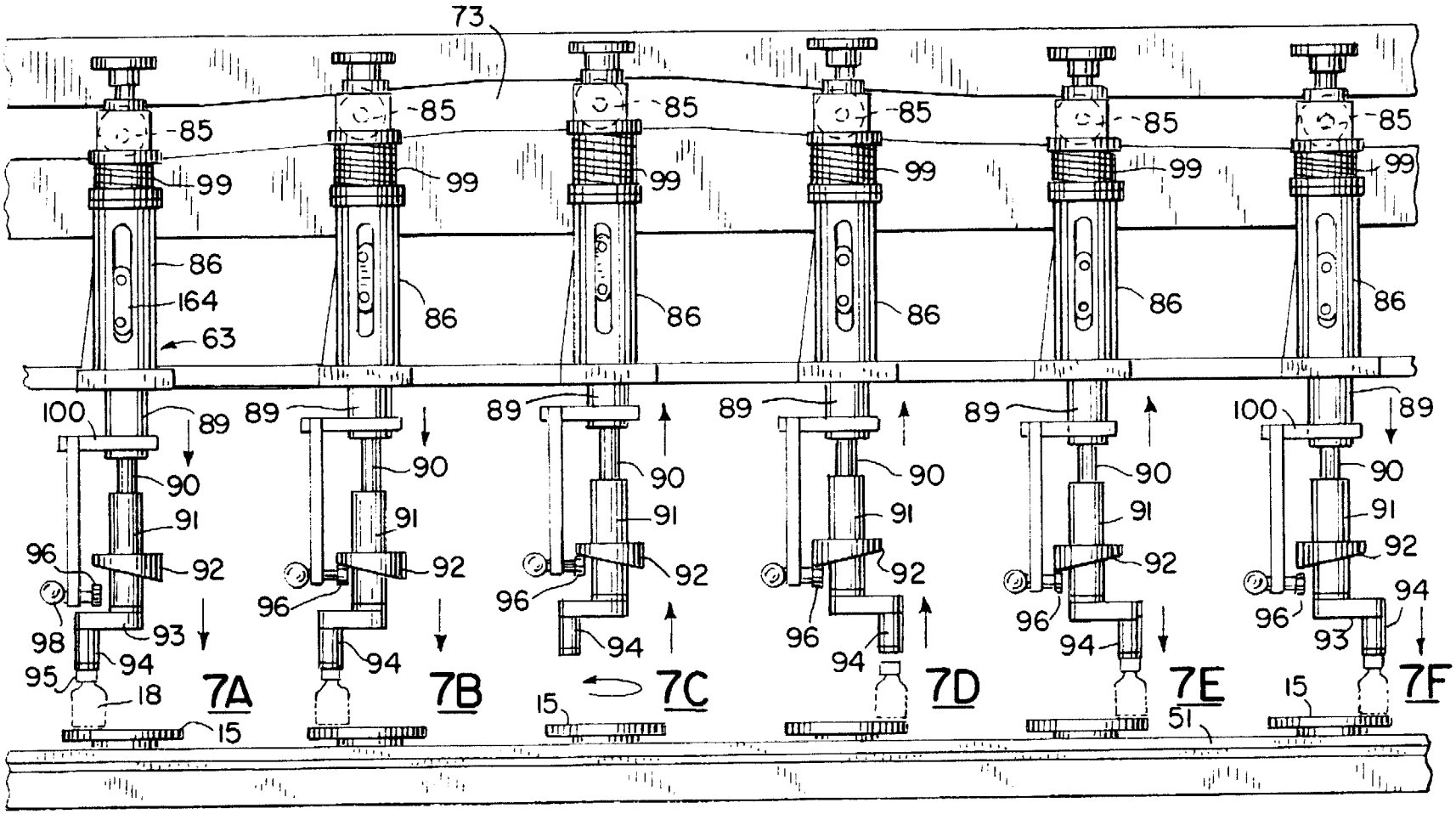
FIG. 7 is a diagrammatic showing of the acquisition, processing and discharge of a bottle from the turntable where the bottle centering and hold down devices and their control mechanisms are shown in various operating stages identified as parts 7A–7F of FIG. 7.
Figure 18:
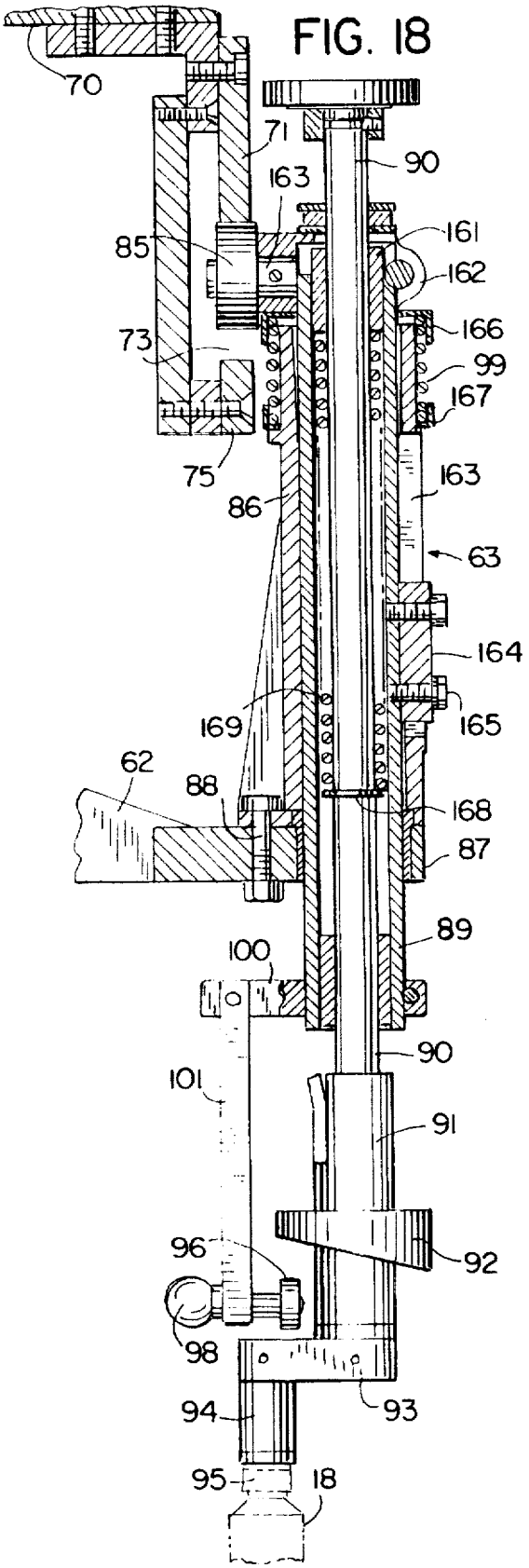
FIG. 18 is a vertical sectional view of a bottle hold-down device as it appears when holding down a bottle.

The bottle hold-down and centering control device 63 construction and operation will now be discussed in reference to FIGS. 18, 19 and 7 additional to the parts just discussed. The device 63 is known per se but will be described briefly as it is used in the environment of present concern. FIG. 18 shows in phantom lines a bottle that is assumed to be presently pressed and stabilized in a bottle receiving cavity of a bottle plate 15 which is not shown in FIG. 18 but is shown in FIG. 7. The device 63 has a generally cylindrical body 86 which is fixedly mounted to a radial arm 62 of the turntable 10 by way of a bolt 88. There is one such body 86 above each bottle holder plate 15. The body 86 has a bore in which the plunger sleeve 89 is axially movable. The upper end of plunger sleeve 89 has a bushing 161 fitted on it. Bushing 161 can move biaxially with plunger sleeve 89. A split clamp 162 has a bolt 163 which is tightened to fasten the clamp to bushing 161 and plunger sleeve 89. Clamp 162 has a shaft 163 pinned to it. Cam follower roller 85 is rotatable on shaft 163 as the roller follows cam groove 73. Cam follower roller 85 is at its lower limit position in FIG. 18. Thus, plunger sleeve 89 is at its lower limit position too. The desirable consequence is that the lower cam follower roller 96 is held securely spaced from its cooperating cam 92. The outer fixed cylindrical body 86 has a longitudinally extending guide slot 163 in it. A guide member 164 can move up and down in the guide slot. Guide member 164 is fastened to plunger sleeve 89 with machine screws 165. Plunger sleeve 89 is prevented from rotating by the guide member. Hence, lower cam follower roller 96 can move up and down with plunger sleeve 89 but the follower roller cannot swing about a vertical axis. The upper end of fixed outer cylinder 86 is configured to receive a spring 99. The spring 99 exerts a lifting force on clamp 162 and on plunger sleeve 89 for the purpose of assuring that the cam follower roller 85 stays in contact with cam member 71.

Vertical shaft 90 is arranged concentrically within plunger sleeve 89. A C-ring 168 is fitted on shaft 90. A coil spring 169 is interposed between C-ring 168 and bushing 161. Since clamp 162 is undergoing a downward force by reason of upper cam roller 85 being at the lowest level in cam groove 73, a resilient compressive force is transmitted from clamp 162 and plunger sleeve 89 through spring 169 to shaft 90. This force is conducted through cylinder 91, crank arm 93, and hold-down element 94 to bottle cap 95 so the bottle 18 is held in its complementarily shaped cavity 16 in circular holder plate 15.

The state of the centering and bottle hold-down device 63 in FIG. 18 corresponds to the state of the device in part 7A of FIG. 7. Part A of FIG. 7 is illustrative of the situation where bottle 18 has just been placed in the bottle cavity 16 of a bottle holder plate 15 by the infeed starwheel 17. It is at this moment that cam follower roller 85 arrives in the lowermost level of cam groove 73 so bottle pressing element 94 on free wheeling crank 93 grips the cap on bottle 18.

Figure 9:
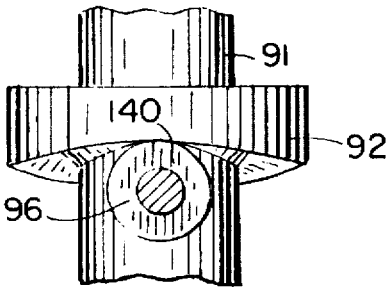
FIGS. 9 and 10 show a cam and a cam follower arrangement in different operating positions, the arrangements being part of the hold down devices depicted in FIG. 8.
Figure 10:
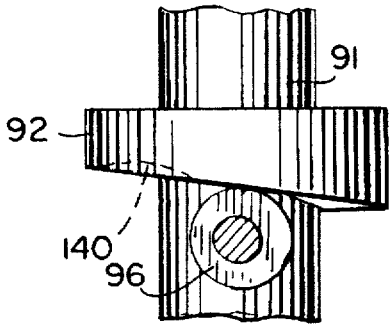
Figure 19:
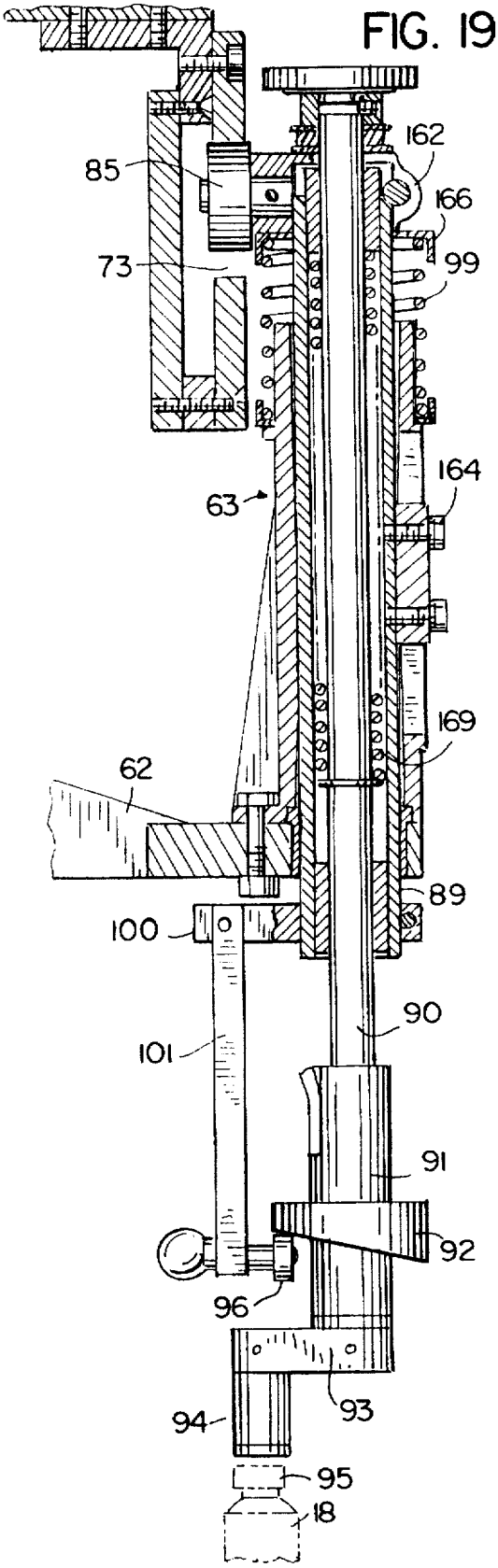
FIG. 19 is similar to the preceding figure except that the hold-down device has been operated to release the bottle.

In FIG. 19 the cam follower roller 85 is assumed to have moved onto the highest level of cam groove 73 so that plunger sleeve 89 is lifted away from the bottle 18 as shown. This event is coincident with the bottle having been received in a pocket 12 of the outfeed starwheel 17 so the bottle remains upright and in a stable state while being conveyed away from the outfeed starwheel 17. This operational state corresponds to part 7C of FIG. 7 where plunger sleeve 89 is at its upper level limit so as to hold lower cam follower roller 96 against the beveled surface of cam 92 under the influence of spring 99. In parts 7B and 7C of FIG. 7 the lower cam follower roller 96 has registered in the detent notch 140 of cam 92 which is visible in FIG. 9. Thus, the crank parts 93 and 94 are stabilized against rotation.

Because crank arm 93 is free wheeling, measures must be taken to assure that crank arm 93 will be in the proper angular position for the axis of hold-down element 94 to be aligned with the vertical axis of bottle 18 when element 94 is ready to come down on cap 95 of the next bottle to come along on the infeed starwheel 13. When, as in part C of FIG. 7, the bottle has been removed to the outfeed starwheel, cam roller 85 in cam groove 73 and plunger sleeve 89 are at their highest level, spring 89 in FIG. 19 is exerting a downward force on shaft 90. This force is applied through lower cam 92 to cam roller 96. Roller 96 is on the inclined plane of cam 92 so a component of force develops that causes the cylinder on which cam 92 is fastened to rotate. Hence, crank arm 93 swings to the position in which it appears in part D of FIG. 7. At this time a bottle 18 is being transferred from infeed starwheel 13 to bottle holder plate 15 and the axis of hold-element 94 is centered above the bottle cap. Then, as in part 7F of FIG. 7, as upper cam roller 85 descends toward its lowermost level in cam groove 73, plunger sleeve 89 is shifted downwardly in which case crank arm 93 is able to swing freely again so the hold-down member 95 stays on the bottle cap as the bottle oscillates on its axis while bottle holder plate 15 turns to facilitate application of glue to the bottles and pickup of inserts.

Although a preferred embodiment of the invention has been described in detail, such description is intended to be illustrative rather than limiting, for the invention may be variously embodied and is to be limited only by interpretation of the claims which follow.

I claim:

1. Apparatus for adhering outserts to an application surface of respective containers that have vertical axes and differing widths, comprising:

a turntable for being driven rotationally about a vertical axis, an adhesive applicator and an outsert dispenser positioned radially from said vertical axis in the stated order in respect to the rotational direction of said turntable, a plurality of support member shafts mounted to said turntable with their axes at equal radial distances from and parallel to said vertical axis of the turntable and equiangularly spaced apart and means for oscillating said shafts at least during a part of a turntable rotation, a support member mounted to each of said shafts for oscillating with the shaft, and means for adapting said apparatus to apply outserts to containers of differing widths including one set of container holder plates releasably mountable, respectively, to said support members, wherein each holder plate in the one set has a recess positioned in the plate for receiving and holding a said container of one width in a position such that said outsert application surfaces of containers having the one width are offset from the axes of the shaft and including an alternative set of holder plates having a recess positioned for receiving and holding containers having widths greater or lesser than the containers having the one width at the same distance from the axes of said support member shafts as are the outsert application surfaces of containers having the one width.

2. Apparatus according to claim 1 wherein said recesses in said holder plates are configured as a selected one of a circular, square, rectangular or oblong configuration for receiving containers, respectively, having complementary cross sectional configurations.

3. Apparatus according to claim 1 wherein a container clamping device is arranged above each container support member for stabilizing a container that is present in a holder plate, the clamping device including:

a body fixedly mounted relative to the turntable above each container support member, an element that is reciprocable vertically relative to said body and a cam follower coupled to said element, a cam arranged along the path defined for the followers to follow through at least a part of a rotation of the turntable, the followers cooperating with the cam to elevate said element when a container is to be placed on a holder plate and then to lower the shaft element toward the container, a crank arm member mounted to and extending radially from said element for rotating freely about a vertical axis that is coincident with the axis of a said support member shaft, said crank arm member being adapted to press down on said container under the influence of said cam at a place that is spaced radially from the coincident axis of the support member shaft and said element.

4. Apparatus according to claim 1 wherein:

said adhesive applicator is a resilient roller, a cam is arranged in a plane transverse to the axis of said turntable, with portions of said cam at greater and lesser distances from the axis of the turntable, a pinion on each of said plurality of support member shafts on which said container holder plates are mounted, gear segments mounted, respectively, proximate the pinions for swinging in alternate directions about axes that are parallel to the axes of said support member shafts, said segments having gear teeth meshed with said pinions and cam followers mounted to the gear segments, respectively, for engaging said cam to cause said gear segments to swing at predetermined angles in response to said turntable moving said followers along said portions of the cam, said cam portions being arranged and positioned to swing said gear segments to an angle that causes said application surface of the container to present to said glue rollers when transported whereto by said turntable and for said application surface to move directly toward said outsert in the dispenser when transported to said outsert dispenser by said turntable and after glue on said application surface contacts said outsert for said application surface to back directly away with the outsert adhered to said surface.

5. A method of attaching outserts containers that are symmetrical to their central vertical axis and where the containers each have at least one surface on which an outsert is to be attached and where the containers differ from each other at least in respect to their widths, comprising the steps of:

providing a turntable that is driven rotationally and continuously about a vertical axis, arranging a plurality of shafts with support members thereon in a circle on said turntable concentric to said vertical axis and oscillating said shafts about their axes at least while said shafts and support members thereon are transported consecutively by said turntable through an arcuate path corresponding to an angle that is at least part of a total angle of rotation for the turntable, having positioned along said arcuate path at a radial distance from said axis of the turntable an adhesive applicator and an outsert dispenser, having releasably mounted to said support members, respectively, holder plates having recesses configured for receiving complementarily shaped containers that hold said containers having one width with their surfaces that are to receive an outsert offset at a fixed radial distance from the axes of the shafts for the containers to cooperate with said adhesive applicator and said outsert dispenser as the containers pass the adhesive applicator and outsert dispenser, and when such containers differing in widths from containers of said one width are to have outserts attached performing the steps of:

removing said holder plates from said support members that have recesses for holding containers that have said one width and replacing them with holder plates that have recesses for holding containers that have a width that differs from said one width but hold said containers with their surfaces on which an outsert is to be attached offset from the axes of the respective shafts by the same distance that the surfaces of said containers having the one width were offset from said axes of the shafts and with the central vertical axes of said other containers offset from the axes of the shafts.

6. A method according to claim 5 wherein:

arranging of said adhesive applicator and said outsert dispenser at said arcuate path are in the stated order in the direction of rotation of said turntable.

7. A method according to claim 6 wherein said adhesive applicator is a roller having a periphery composed of a pliable material and said dispenser presents outserts toward said arcuate path and including the steps of:

oscillating said shafts about their axes in such timed relationship relative to arrival of an outsert receiving surface of a container at said periphery of said roller and the surface of an outsert in said dispenser such that said surface of the container contacts said roller while oscillating at a particular rate and said same surface of the container with adhesive thereon rolls on said presented outsert while oscillating at said same particular rate.

8. A method according to claim 5 including the step, after having replaced said plates, of adjusting the said radial distance of said adhesive applicator and said outsert dispenser from said axis of the turntable only by a sufficient amount to account for any difference between the thickness of the outserts attached to said one containers and the others.

* * * * *